US007197877B2

(12) United States Patent
Moraes

(10) Patent No.: US 7,197,877 B2
(45) Date of Patent: Apr. 3, 2007

(54) SUPPORT SYSTEM FOR A PILOT NOZZLE OF A TURBINE ENGINE

(75) Inventor: Ricardo Ferreira Moraes, Orlando, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 353 days.

(21) Appl. No.: 10/910,866

(22) Filed: Aug. 4, 2004

(65) Prior Publication Data

US 2006/0026966 A1 Feb. 9, 2006

(51) Int. Cl.
*F02C 7/22* (2006.01)

(52) U.S. Cl. ..... 60/740; 239/533.2; 239/602

(58) Field of Classification Search ..... 60/740, 60/742, 752; 239/533.2, 597, 600, 602
See application file for complete search history.

(56) References Cited

U.S. PATENT DOCUMENTS

| | | | | |
|---|---|---|---|---|
| 4,852,803 | A * | 8/1989 | Gaskell | 239/86 |
| 5,343,694 | A | 9/1994 | Toborg et al. | |
| 5,465,571 | A | 11/1995 | Clark | |
| 6,032,457 | A | 3/2000 | McKinney et al. | |
| 6,038,862 | A | 3/2000 | Melman et al. | |
| 6,053,432 | A * | 4/2000 | Stevens | 239/533.2 |
| 6,351,948 | B1 | 3/2002 | Goeddeke | |
| 6,357,222 | B1 | 3/2002 | Schilling et al. | |
| 6,666,029 | B2 | 12/2003 | Ryan | |
| 6,705,087 | B1 | 3/2004 | Ohri et al. | |
| 6,708,495 | B2 | 3/2004 | Calvez et al. | |
| 2002/0139121 | A1 | 10/2002 | Cornwell et al. | |
| 2003/0024249 | A1 | 2/2003 | Akagi et al. | |
| 2004/0006990 | A1 | 1/2004 | Stuttaford et al. | |
| 2004/0006991 | A1 | 1/2004 | Stuttaford et al. | |
| 2004/0006992 | A1 | 1/2004 | Stuttaford et al. | |
| 2004/0006993 | A1 | 1/2004 | Stuttaford et al. | |
| 2004/0020210 | A1 | 2/2004 | Tanaka et al. | |
| 2004/0025494 | A1 | 2/2004 | Vache et al. | |
| 2004/0045295 | A1 | 3/2004 | Wiebe et al. | |
| 2004/0050058 | A1 | 3/2004 | Ohri et al. | |
| 2004/0055311 | A1 | 3/2004 | Swinford et al. | |

* cited by examiner

*Primary Examiner*—L. J. Casaregola

(57) ABSTRACT

An automatic recovery pilot nozzle support system for supporting a pilot nozzle in a fuel injection system of a turbine engine. The support system includes a sleeve extending from an orifice in a support housing, wherein the sleeve has a hollow opening for containing a pilot nozzle. The sleeve may increase the natural frequency of the pilot nozzle above an excitation zone, thereby limiting destructive vibrations. The sleeve may be attached to the support housing with an interference fit. The automatic recovery aspect of the support system enables the sleeve to maintain an interference fit with the support housing such that anytime the sleeve looses contact with the support housing, an insulative film of air forms between the sleeve and the support housing. The insulative film of air causes the temperature of the sleeve to increase, and the sleeve to expand and reform the interference fit with the support housing.

15 Claims, 3 Drawing Sheets

SUPPORT SYSTEM FOR A PILOT NOZZLE OF A TURBINE ENGINE

FIELD OF THE INVENTION

This invention is directed generally to turbine engines, and more particularly to pilot nozzle support systems of a turbine engine fuel assembly.

BACKGROUND

Typically, gas turbine engines include a compressor for compressing air, a combustor for mixing the compressed air with fuel and igniting the mixture, a fuel injection system, and a turbine blade assembly for producing power. Combustors often operate at high temperatures that may exceed 2,500 degrees Fahrenheit. Typical turbine combustor configurations expose components of turbine engine fuel systems to these high temperatures. Turbine engines fuel systems typically include pilot nozzles for injecting fuel into a combustion chamber. Conventionally, pilot nozzles have been bolted to a support housing to attach the pilot nozzles to turbine engines. A typical support housing consists of a base having an orifice extending through the base for receiving the pilot nozzle. The pilot nozzle is bolted directly to the base. During use of this conventional configuration, the pilot nozzle has a natural frequency that falls within an excitation zone, which thereby subjects the pilot nozzle to destructive vibrations.

Other conventional support assemblies have included sleeves coupled to the orifices of the support housings to increase the natural frequencies of the pilot nozzles such that the natural frequencies are outside excitation zones to reduce, if not eliminate, destructive vibrations. Typically, the sleeves have been welded to the support housings. However, the welds have not had a sufficiently long life as a result of the vibrations inherent in operating turbine engines. Thus, a need exists for a more efficient, reliable pilot nozzle support system.

SUMMARY OF THE INVENTION

This invention relates to an automatic recovery pilot nozzle support system for a pilot nozzle of a fuel system of a turbine engine. The support system is configured to support a pilot nozzle with a sleeve and to increase the natural frequency of the pilot nozzle outside an excitation range to avoid destructive vibrations. The support system includes a sleeve that maintains contact with a support housing at substantially all times of operation of a turbine engine. Should the sleeve ever lose contact with the support housing during operation of a turbine engine, an insulative film of air may form between the sleeve and the support housing causing the sleeve to increase in temperature relative to the support housing. The sleeve, as a result, expands and regains contact with the support housing.

The support system may include a support housing having at least one orifice, a hollow sleeve positioned in the orifice of the support housing and having an outer diameter that is greater than an inner diameter of the orifice such that an interference fit exists between the support housing and the sleeve. The hollow sleeve may be adapted to receive a nozzle positioned in the hollow sleeve and generally aligned with the hollow sleeve. The hollow sleeve may also have first and second sections in which the first section may have a diameter that is greater than a diameter of the second section. The second section may be configured to contact and support a nozzle. The sleeve may also include a retention protrusion, which may be in the form of a ring and referred to as a collar, on an end of the sleeve for preventing the sleeve from being inserted completely through the support housing.

The support housing may include a collar extending from a base of the support housing towards an unsupported end of the sleeve to a point that is less than half a total length of the sleeve from the base. The collar may also extend a distance of about one third of a total length of the sleeve from the base. The collar may also form a portion of the orifice extending through the support housing and may have an inner diameter that is less than an outer diameter of the sleeve.

The support system may be assembled by first exposing the sleeve to a temperature less than ambient temperature to reduce the temperature of the sleeve to a temperature sufficient to reduce the diameter of the sleeve such that the sleeve may be inserted into the orifice in the support housing. The sleeve may then be inserted into the support housing, and the temperature of the sleeve allowed to return to ambient temperature. As the temperature of the sleeve increases toward ambient temperature, the sleeve increases in diameter and can form an interference fit with the support housing. A pilot nozzle may be inserted into the sleeve in a variety of manners to position the pilot nozzle in the sleeve.

During operation, the support housing supports a pilot nozzle within a combustion chamber of a turbine engine. As the engine runs, the combustion chamber, and as a result, the support system and pilot nozzle, increase in temperature. As the sleeve of the support system increases in temperature and expands, the sleeve maintains contact with the support housing. Should the sleeve lose contact with the support housing, a film of insulative air may develop between the sleeve and the support housing causing the temperature of the sleeve to increase relative to the support housing. The increase in temperature of the sleeve causes the sleeve to expand and regain contact with the support housing.

An advantage of this invention is that the support system has an automatic support system configured such that should a sleeve of a pilot nozzle support system loose contact with a support housing, the sleeve will rapidly heat, expand, and regain contact with the support housing, thereby reestablishing an interference fit with, and the support of, the support housing.

Another advantage of this invention is the support system eliminates welds of conventional support systems that are typically exposed to extreme temperature gradients for attaching a sleeve of a pilot nozzle support system to a support housing.

Yet another advantage of this invention is the support system may be assembled in a time efficient manner with few assembly steps.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
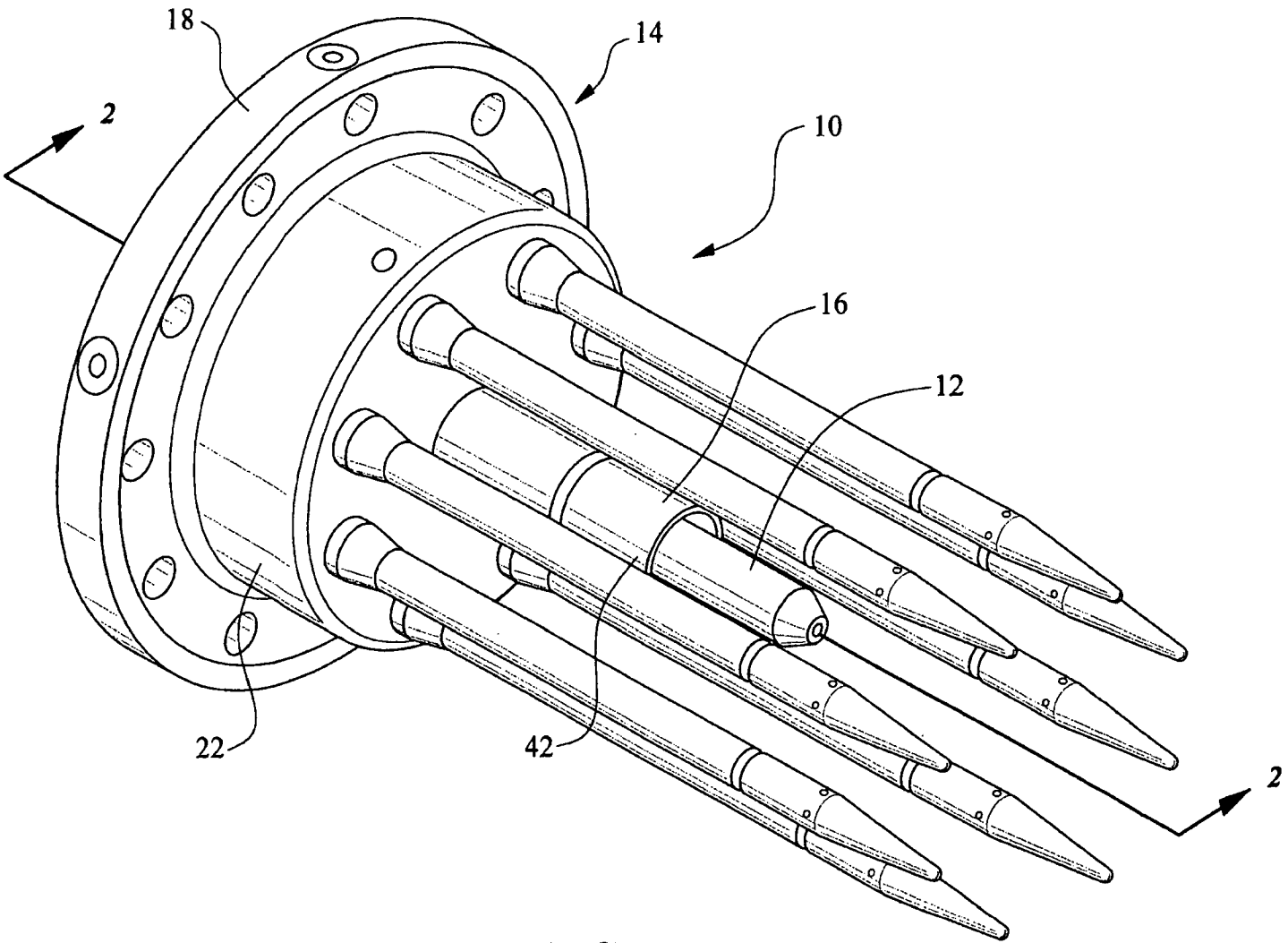
FIG. 1 is a perspective view of a pilot nozzle support system according to aspects of the invention.

This invention is directed to an automatic recovery pilot nozzle support system 10 usable in a turbine engine. As shown in FIGS. 1–4, the support system 10 enables a pilot nozzle 12 to be securely fastened to a support housing 14 of a turbine engine fuel system 16 throughout various engine operating loads and resulting thermal heating cycles. While the invention is directed to a support system for a pilot nozzle 12, the invention may also be used with other injector nozzles in a turbine engine and is not limited only to pilot nozzles. The support system 10 is configured such that during a natural heating cycle of a turbine engine during operation, the pilot nozzle is held by a sleeve 16 that maintains contact with the support housing 14 at substantially all times. In the event the sleeve 16 loses contact with the support housing 14, the thermal characteristics of the sleeve 16 cause the sleeve 16 to rapidly expand and regain contact with the support housing 14, thereby preventing the sleeve 16 from being unsupported by the support housing 14 for any extended period of time. In addition, the sleeve 16 acts to raise the natural frequency of the pilot nozzle 12 outside an excitation zone to reduce destructive vibrations in the pilot nozzle 12.

Figure 2:
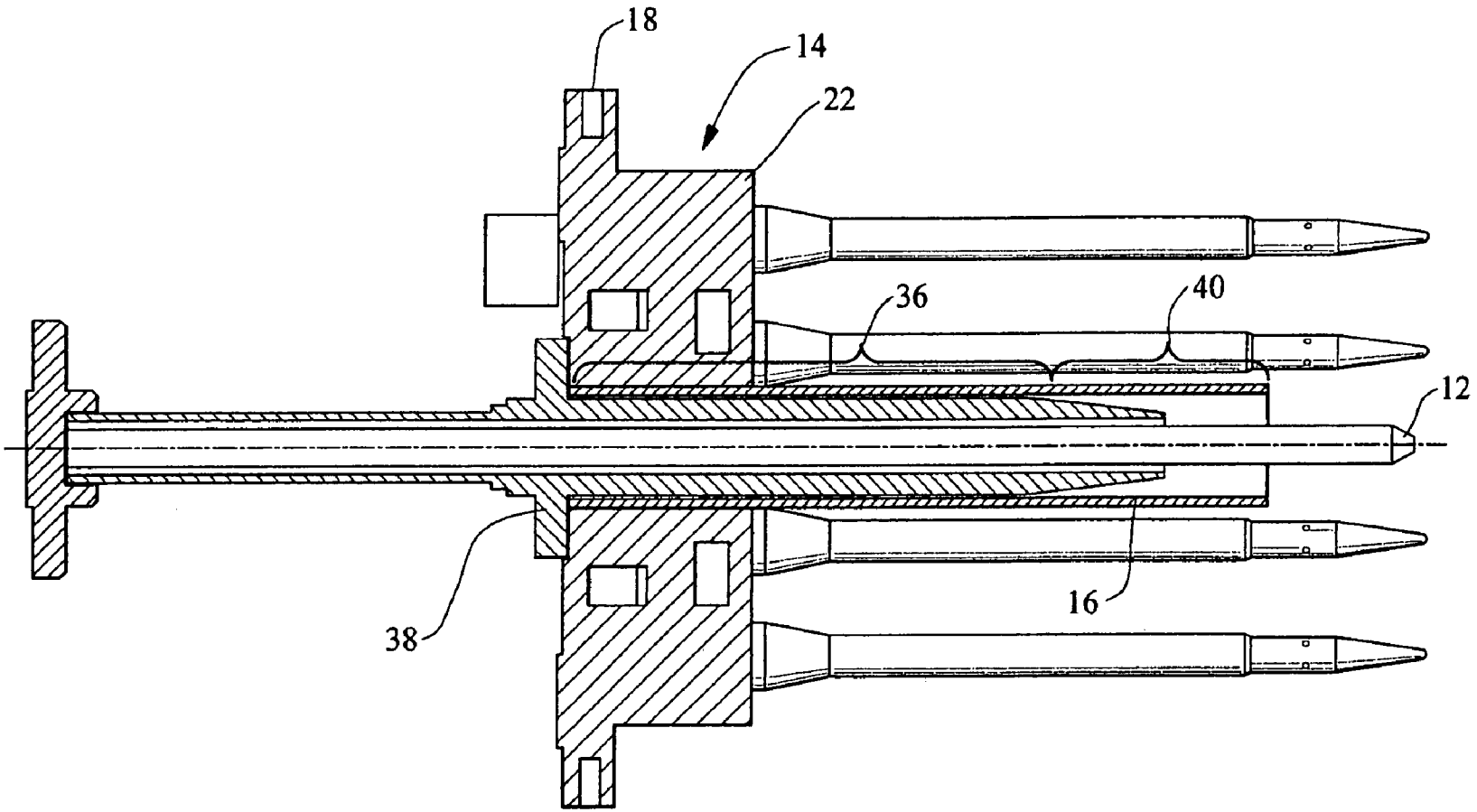
FIG. 2 is a cross-sectional view of the support system shown in FIG. 1 taken along section line 2—2 together with a pilot nozzle.

The support housing 14, as shown in FIGS. 1 and 2, may be formed from a base 18 having one or more orifices 20 for receiving the sleeve 16. The support housing 14 may also include a collar 22 extending away from the base 18 for providing additional support for the sleeve 16. The collar 22 may vary in length, but in at least one embodiment, the collar 22 may extend from the base a length less than or equal to about one half of a total length of the sleeve 16. In yet another embodiment, the collar 22 may extend from the base 18 a distance equal to about one third of a length of the sleeve 16. An inside surface 24 of the collar 22 may form a portion of the orifice 20.

Figure 3:
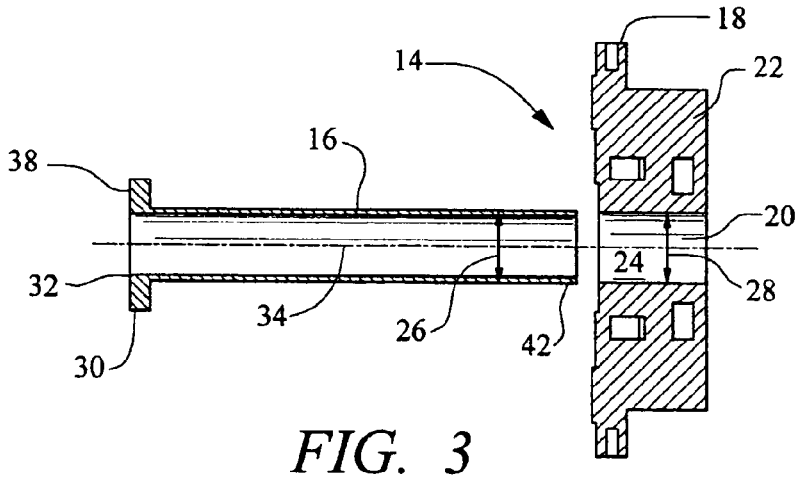
FIG. 3 is a partial cross-sectional exploded view of the support system shown in FIG. 1 without a pilot nozzle.

As shown in FIG. 3, the sleeve 16 may be a hollow cylinder, such as a tube, having an outer diameter 26 that is larger than an inner diameter 28 of the orifice 20 in the support housing 14 or the collar 22, or both. This configuration enables the sleeve 16 to form an interference fit when positioned inside the orifice 20 of the support housing 14. The sleeve 16 may also include a retention protrusion 30 extending from a base 32 of the sleeve 16 for limiting movement of the sleeve 16 along a longitudinal axis 34 into the support housing 14 and more specifically, to prevent the sleeve 16 from sliding entirely through the support housing 14. In at least one embodiment, the retention protrusion 30 is a ring coupled to the base 32 of the sleeve 16. The sleeve 16 may also include a first region 36 proximate to an end 38 of the sleeve 16 mountable in the support housing 14 and a second region 40 near the unsupported end 42 of the sleeve 16. In at least one embodiment, the first region 36 may have an inner diameter that is great than or equal to an inner diameter of the second region 40. The second region 40 may be configured to contact the pilot nozzle 12 when the pilot nozzle 12 is positioned in the sleeve 16.

Figure 4:
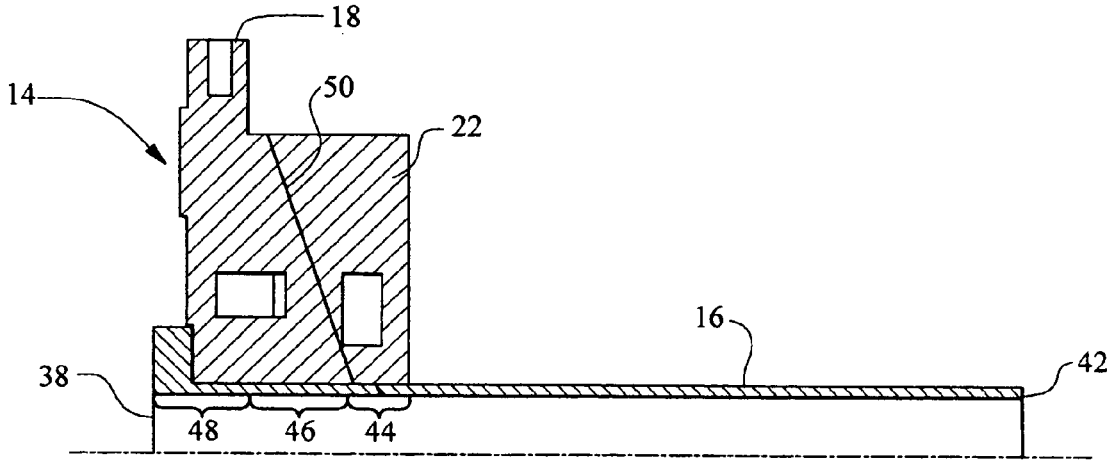
FIG. 4 is partial cross-sectional view of the pilot nozzle support system shown in FIG. 1 taken along section line 2—2 showing a temperature gradient.

As shown in FIGS. 2 and 3, the sleeve 16 may form an interference fit with the support housing 14. As shown in FIG. 4, the interference fit may be divided into region 44, region 46, and region 48. Because of the necessity to maintain an interference relationship between the sleeve 16 and the support housing 14 for support of the pilot nozzle 12 and to avoid natural frequencies in the excitation range of between 180 Hz and 200 Hz, regions 44, 46, and 48 may be manufactured with tight tolerances. In particular, it is important that an interference fit be maintained in the region 44. While the sleeve 16 in regions 46 and 48 may lose contact with the support housing 14, the sleeve 16 preferably does not lose contact with the support housing 14. In at least one embodiment, the total distance of regions 44, 46, and 48 is between about two inches and about six inches, and in at least one embodiment, is about four inches.

The support system 10 may be assembled by shrinking the sleeve 16 by exposing the sleeve 16 to a temperature less than ambient temperature to cause thermal contraction of the material forming the sleeve 16. In at least one embodiment, the sleeve 16 may be exposed to liquid nitrogen, other appropriate substance, or a reduced temperature climate condition to reduce the temperature of the sleeve 16. The temperature of the sleeve 16 may be reduced to such an extent that the outer diameter 26 of the sleeve 16 may be reduced to be less than the inside diameter 28 of the orifice 20 in the support housing 14. The sleeve 16 may then be inserted into the orifice 20 in the support housing 14. An interference fit may be established between the sleeve 16 and the support housing 14 by enabling the sleeve to return to ambient temperature. In alternative embodiments, the temperature of the support housing 14 may be increased to increase the size of the orifice 20 so that the sleeve 16 may be inserted into the orifice 20. The pilot nozzle 12 may be inserted into the sleeve 16 and attached to the sleeve 16 using any appropriate method.

During operation of the turbine engine, the temperature of the pilot nozzle 12 and automatic recovery pilot nozzle support system 10 increase together with the turbine engine. The interference fit between the sleeve 16 and the support housing 14 may be maintained for substantially all, if not all, time in which the turbine engine is operating. For instance, the interference fit may be maintained through all transient trips and at all engine running conditions, such as, but not limited to, 30 percent base load with either cold or heated fuel, base load with either cold or heated fuel, and other operating conditions.

The automatic recovery aspect of the support system 10 enables the sleeve 16 to maintain contact with the support housing 14 during operating conditions in a turbine engine. For instance, when an interference fit is maintained between the sleeve 16 and the support housing 14, as shown in FIG. 4, a temperature gradient 50 is maintained. Should the sleeve 16 lose contact with the support housing 14 during operation of a turbine engine, a film of air, which acts as insulation, is formed between the sleeve 16 and the support housing. The insulative layer of air causes the sleeve 16 to increase in temperature, which in turn causes the sleeve 16 to expand until the sleeve 16 again contacts the support housing 14 and reforms the interference fit. This process may happen one or more times throughout an engine operating period.

The interference fit may be sized and the materials forming the support housing 14 and the sleeve 16 chosen such that during operation, the interference fit is maintained between the support housing and the sleeve 16 but the stresses are minimized. Thus, the inner diameter 28 of the orifice 20 may be smaller than the outer diameter 26 of the sleeve 16, but not to such an extent that destructive stresses are created in the sleeve 16 or the support housing 14, or both. In fact, during operation, a portion of the sleeve 16 in contact with the support housing 14 may relax during thermal cycle operation to prevent the sleeve 16 from undergoing plasticity.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. An automatic recovery fuel nozzle support system of a turbine engine, comprising:

a support housing having at least one orifice; and a hollow sleeve positioned in the at least one orifice and having a pre-installation outer diameter that is greater than an inner diameter of the at least one orifice of the support housing such that an interference fit exists between the support housing and the hollow sleeve;

a nozzle positioned in the at least one orifice of the hollow sleeve and generally aligned with the hollow sleeve.

2. The automatic recovery fuel nozzle support system of claim 1, wherein the support housing further comprises a collar surrounding the orifice and forming at least a portion of the orifice.

3. The automatic recovery fuel nozzle support system of claim 2, wherein the collar extends from a base of the support housing towards an unsupported end of the sleeve to a point that is less than about half of a total length of the sleeve from the base.

4. The automatic recovery fuel nozzle support system of claim 3, wherein the collar extends from a base of the support housing towards the unsupported end of the sleeve to a point that is about one third of a total length of the sleeve from the base.

5. The automatic recovery fuel nozzle support system of claim 3, wherein at least a portion of the collar proximate the unsupported end of the sleeve has an inner diameter that is slightly less than inner diameters of the orifice at other locations.

6. The automatic recovery fuel nozzle support system of claim 3, wherein the sleeve further comprises a retention protrusion extending from a base of the sleeve.

7. The automatic recovery fuel nozzle support system of claim 6, wherein the retention protrusion is a ring coupled to the base of the sleeve.

8. The automatic recovery fuel nozzle support system of claim 1, wherein the sleeve has a first region proximate to the support housing having a first diameter and a second region having a second diameter located proximate to an unsupported end of the sleeve, wherein the first diameter is larger than the second diameter.

9. The automatic recovery fuel nozzle support system of claim 8, wherein the portion of the sleeve having the second diameter is sized to contact a fuel nozzle when the fuel nozzle is inserted into the sleeve.

10. An automatic recovery support system for a pilot nozzle of a turbine engine, comprising:

a support housing having at least one orifice;

a hollow sleeve positioned in the at least one orifice and having a pre-installation outer diameter that is greater than an inner diameter of the at least one orifice of the support housing such that an interference fit exists between the support housing and the hollow sleeve; and a pilot nozzle positioned in and supported by the hollow sleeve and generally aligned with the hollow sleeve.

11. The automatic recovery support system of claim 10, wherein the support housing further comprises a collar surrounding the orifice and forming at least a portion of the orifice, and wherein the collar extends from a base of the support housing towards an unsupported end of the sleeve to a point that is less than half a total length of the sleeve from the base.

12. The automatic recovery support system of claim 11, wherein the collar extends from the base of the support housing towards the unsupported end of the sleeve to a point that is about one third of a total length of the sleeve from the base.

13. The automatic recovery support system of claim 11, wherein a portion of the collar proximate the unsupported end of the sleeve has an inner diameter that is slightly less than inner diameters of the orifice at other locations.

14. The automatic recovery support system of claim 11, wherein the sleeve further comprises a ring extending from a base of the sleeve.

15. The automatic recovery support system of claim 10, wherein the sleeve has a first region proximate to the support housing having a first diameter and a second region having a second diameter located proximate to an unsupported end of the sleeve, wherein the first diameter is larger than the second diameter, and the second diameter is sized to contact a pilot nozzle when the pilot nozzle is inserted into the sleeve.

* * * * *